United States Patent [19]

McConnell et al.

[11] 4,122,757

[45] Oct. 31, 1978

[54] FLUID OPERATED ENGINE

[75] Inventors: David P. McConnell, P.O. Box 591, Minden, Nev. 89423; Louis E. Tully, La Canada, Calif.

[73] Assignee: David P. McConnell, Minden, Nev.

[21] Appl. No.: 654,763

[22] Filed: Feb. 3, 1976

[51] Int. Cl.[2] ..... F01B 13/04

[52] U.S. Cl. ..... 91/506; 92/12.2; 91/503

[58] Field of Search ..... 91/499, 506, 503, 180, 91/505, 507; 92/12.2; 417/222

[56] References Cited

U.S. PATENT DOCUMENTS

| | | | |
|---|---|---|---|
| 1,087,861 | 2/1914 | Alexander et al. | 91/505 |
| 1,530,881 | 3/1925 | Burks | 91/180 |
| 2,340,100 | 1/1944 | Arndt | 91/503 |
| 2,505,951 | 5/1950 | Feaster | 91/482 |
| 2,508,309 | 5/1950 | Tweedale | 417/222 |
| 2,549,711 | 4/1951 | Ruben | 91/503 |
| 3,108,543 | 10/1963 | Gregor | 91/505 |
| 3,133,447 | 5/1964 | Mercier | 91/472 |
| 3,157,998 | 11/1964 | Harris | 91/506 |
| 3,255,638 | 6/1966 | Livers | 91/503 |

*Primary Examiner*—William L. Freeh
*Attorney, Agent, or Firm*—Paul A. Weilein

[57] ABSTRACT

A fluid operated engine having a pair of spaced apart disc-like plate members respectively fixedly secured to a pair of drive shaft sections having adjacent ends interconnected by a universal joint, a plurality of pressurized fluid actuated axially expansile and retractile devices extending between and being connected to corresponding circumferentially spaced points of said members, a valve mechanism for sequentially controlling the flow of actuating fluid to and from said devices, said shaft sections being rotatably supported in tiltable bearing supports selectively adjustable to vary the angular relation of the interconnected shaft sections and selectively position the connected plate members respectively in different angular nutating relationships to cause shaft rotations in opposite directions at varied speeds, and in a parallel non-nutating relationship in which the shaft remains stationary.

10 Claims, 13 Drawing Figures

3
3
10
12
14
16
18
20
22a
22b
22c
22d
22e
24
26
28
30
32
36
46
48
52
54
56
60
62
64
68
74
76
78
80
82
84
86
88
90
92
94
96
98
104
110
112
114
116
118
120
121
128a
128b
128c
128d
128e
132a
132e

FIG. 5.
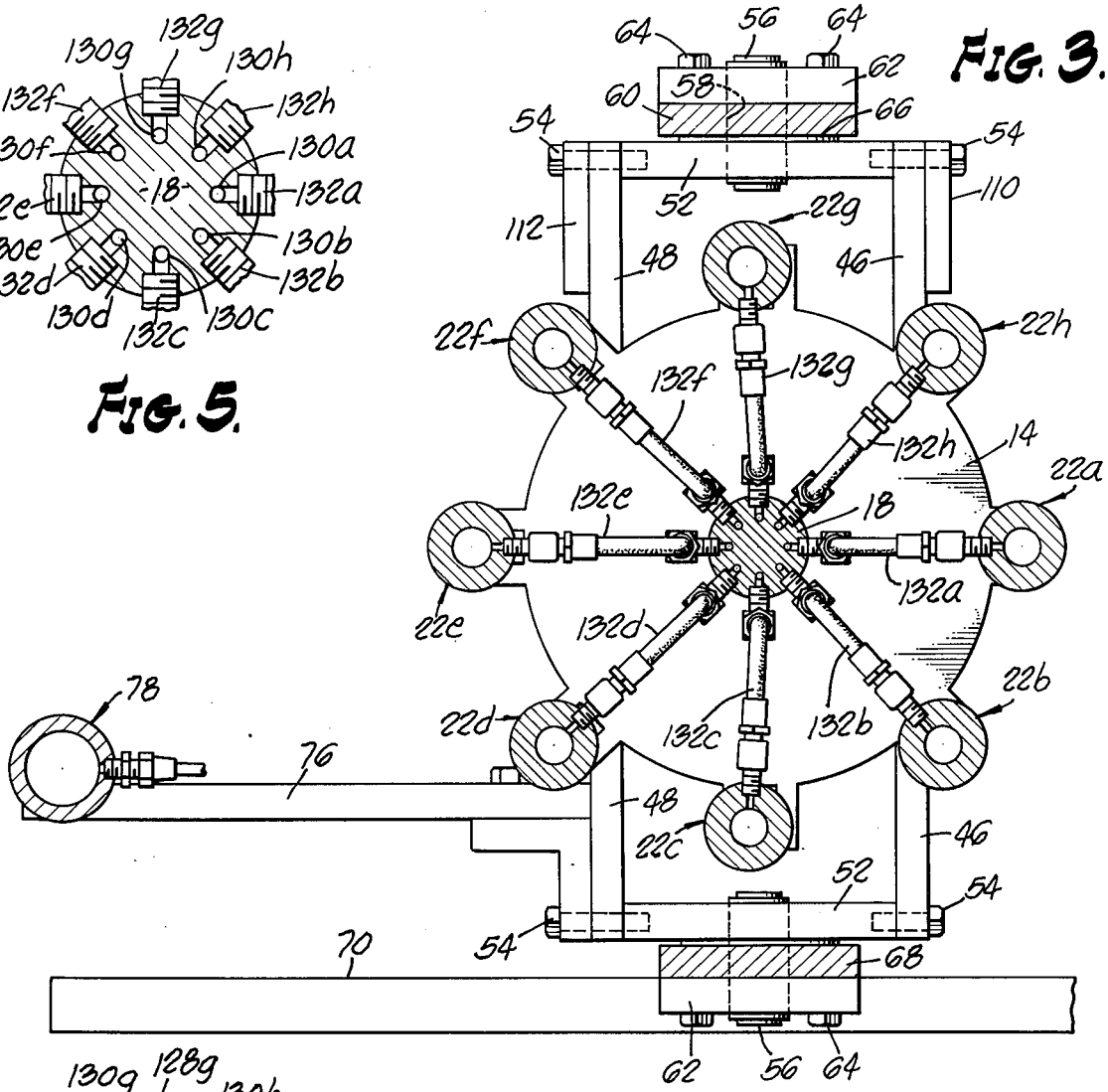
FIG. 3.
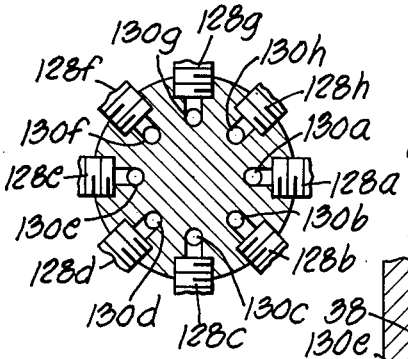
FIG. 6.
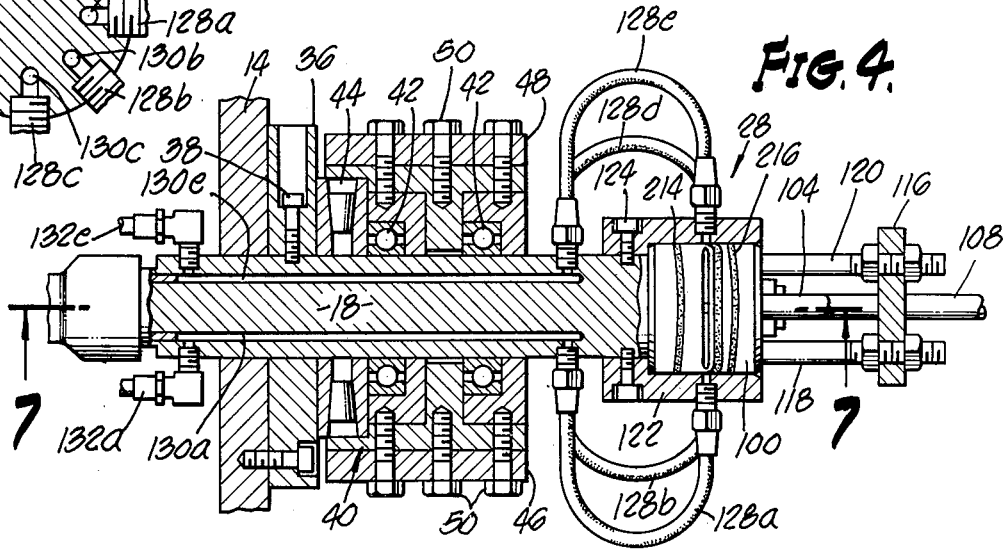
FIG. 4.

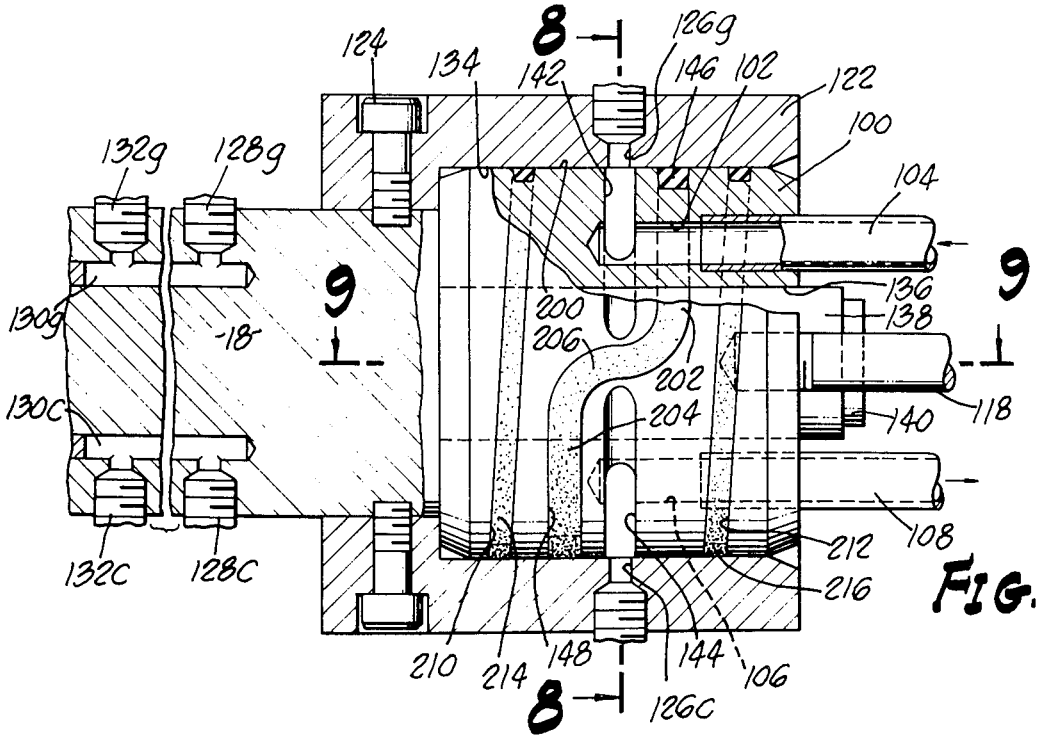
FIG. 7.
FIG. 10.
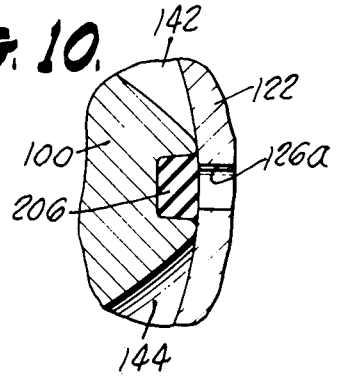
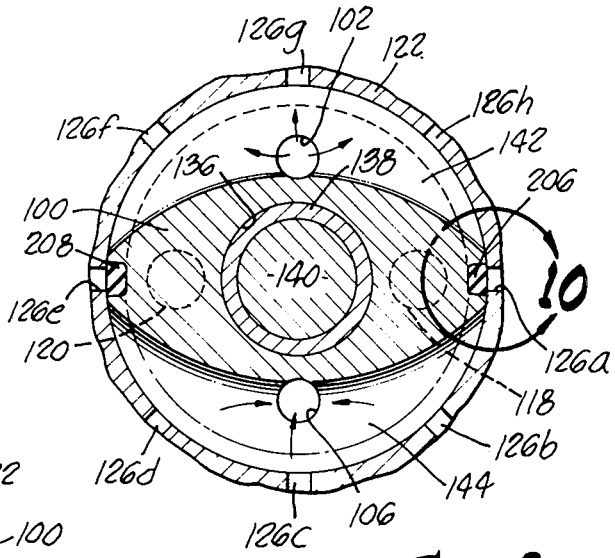
FIG. 8.
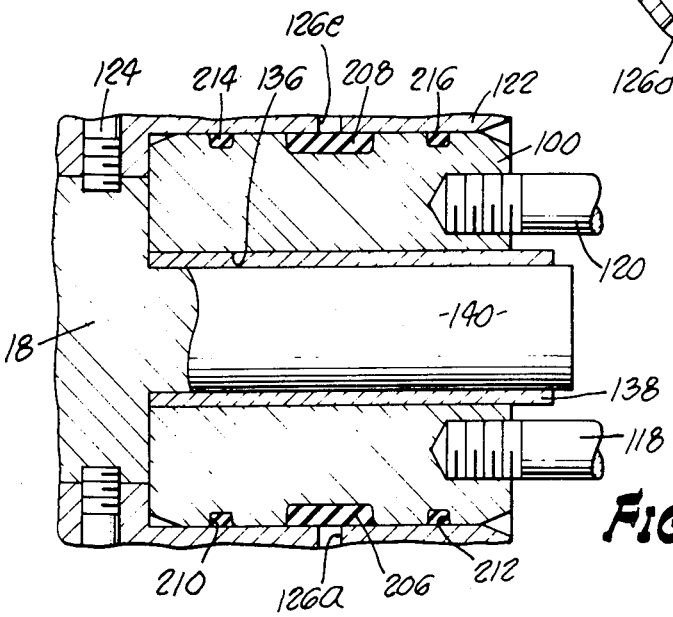
FIG. 9.

FIG. 11.
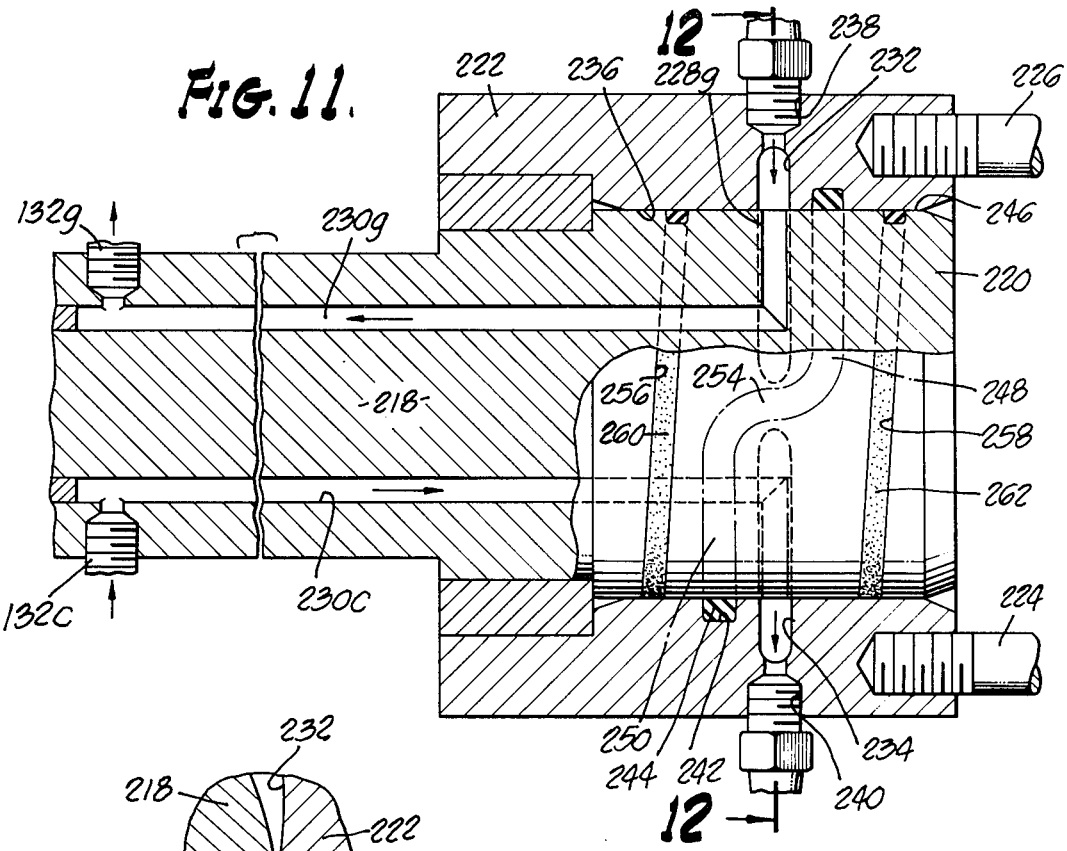
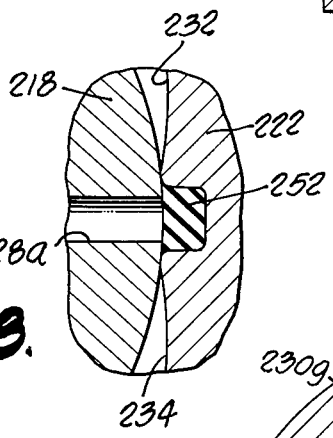
FIG. 13.
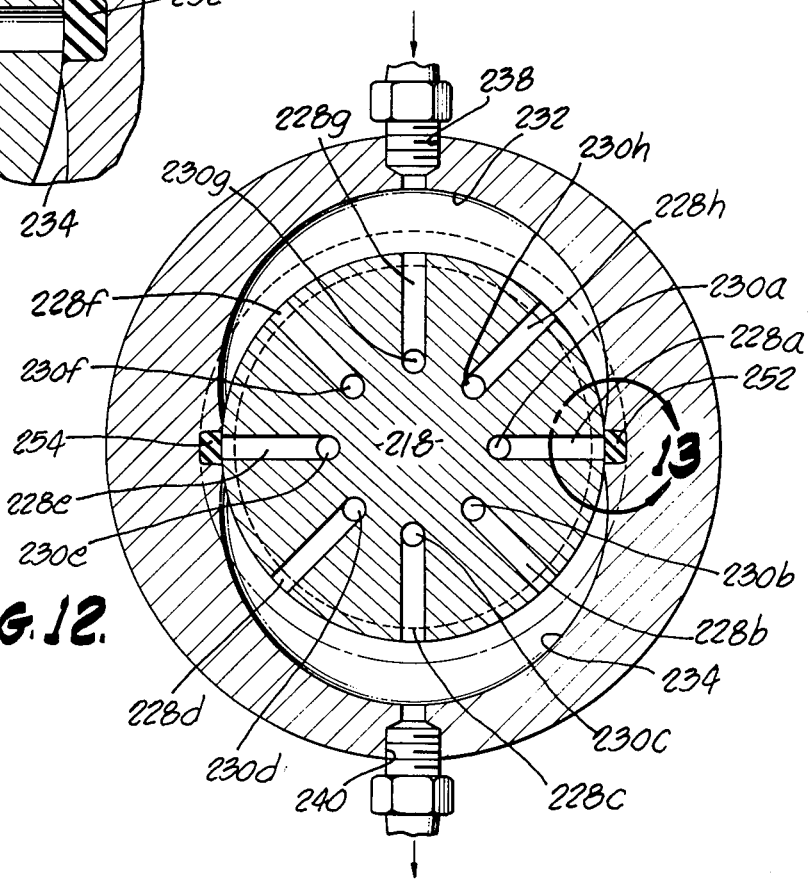
FIG. 12.

FLUID OPERATED ENGINE

BACKGROUND OF THE INVENTION

The present invention relates generally to a fluid operated engine, and is more particularly concerned with a unique and improved engine of the type utilizing nutating discs and associated thrust force producing devices.

The present extensive and increasing use of the internal combustion engine as a power source has created an economic problem due to short supply and high cost of hydrocarbon fuels, as well as a health problem due to atmospheric pollution. These and kindred problems currently have stimulated research and development in the field of engines with a view to producing an engine which could be economically operated on an energy medium that would effectively minimize or eliminate the discharge of pollutants due to the operation of the engine.

One such heretofore known engine having desirable potential possibilities for such purpose operates on pressurized fluid; and in one form embodies the use of a plurality of circumferentially spaced fixed cylinder-piston units which are sequentially supplied with a pressurized fluid, the piston thrust forces being applied against a swash plate to cause rotation of a connected shaft.

With the foregoing in mind, the present invention seeks to provide improvements in the above type of fluid actuated engine, and proposes a unique and improved construction which will be more practical and have a greater field of use not only as a prime mover in plant installations, but also for other installations such as automobiles, boats, and the like, and which may operate from a variety of sources of pressurized fluid which may include tank stored liquid nitrogen, and the like.

SUMMARY OF THE INVENTION

It is one object of the present invention to provide an improved, pressurized fluid actuated engine or pump of unique construction, and which has a wide field of use that may include fixed installations, as well as for use as a prime mover for vehicles, such as automobiles, boats, and the like.

It is a further object to provide an engine according to the foregoing object, which operates on the nutating disc principle, and wherein the relationship of the discs may be selectively changed to produce non-rotation, or rotation in opposite directions at varied speeds.

Another object is to provide a fluid actuated engine having a unique and novel control valve of the rotary type.

The foregoing and other objects are achieved in the present invention by providing a fluid operated engine having a pair of disc-like plate members respectively mounted on a right angled shaft section which is mounted for tilting adjustment, the shaft sections of the respective plate members being interconnected at adjacently disposed ends by a universal joint; a plurality of fluid actuated axially expansile and retractile devices connected to extend between the plate members; and synchronized control valve means for sequentially controlling the actuating fluid with respect to said devices so as to cause rotation of the disc members and the connected shaft sections.

Briefly, the control valve preferably includes a stationary valving element having a fluid inlet connection and a fluid outlet connection, and a rotating manifold element provided with a plurality of flow ports communicating with the fluid actuated devices. The valve elements coact to sequentially connect the flow ports with the fluid actuated devices so as to alternately supply pressurized fluid to each of the fluid actuated devices and vent the device in a manner to cause rotation of the connected shaft sections.

An important feature of the present invention is that the angular relationship of the connected shaft sections can be adjustably varied to provide a condition of non-rotation of the shaft sections, or to reverse the direction and speed of rotation thereof.

Further objects and advantages of the invention will be brought out in the following part of the specification, wherein detailed description is for the purpose of fully disclosing several embodiments of the invention without placing limitations thereon.

BRIEF DESCRIPTION OF THE DRAWINGS

Referring to the accompanying drawings, which are for illustrative purposes only:

FIG. 3 is a transverse sectional view taken generally along the line 3—3 of FIG. 1;

FIG. 4 is a fragmentary longitudinal sectional view taken generally along the line 4—4 of FIG. 2;

FIG. 5 is a fragmentary transverse sectional view taken generally along the line 5—5 of FIG. 2;

FIG. 6 is a fragmentary transverse sectional view taken generally along the line 6—6 of FIG. 2;

FIG. 7 is an enlarged fragmentary sectional view taken generally along the line 7—7 of FIG. 4;

FIG. 8 is a fragmentary transverse sectional view taken generally along the line 8—8 of FIG. 7;

FIG. 9 is a fragmentary sectional view taken generally along the line 9—9 of FIG. 7;

FIG. 10 is a detail view showing on an enlarged scale the encircled portion of FIG. 8;

FIG. 11 is a fragmentary longitudinal sectional view similar to FIG. 7 but showing a modified control valve according to the present invention;

FIG. 12 is a fragmentary transverse sectional view taken generally along the line 12—12 of FIG. 11; and FIG. 13 is a detail view showing on an enlarged scale the encircled portion of FIG. 12.

DESCRIPTION OF THE PREFERRED EMBODIMENTS

Figure 1:
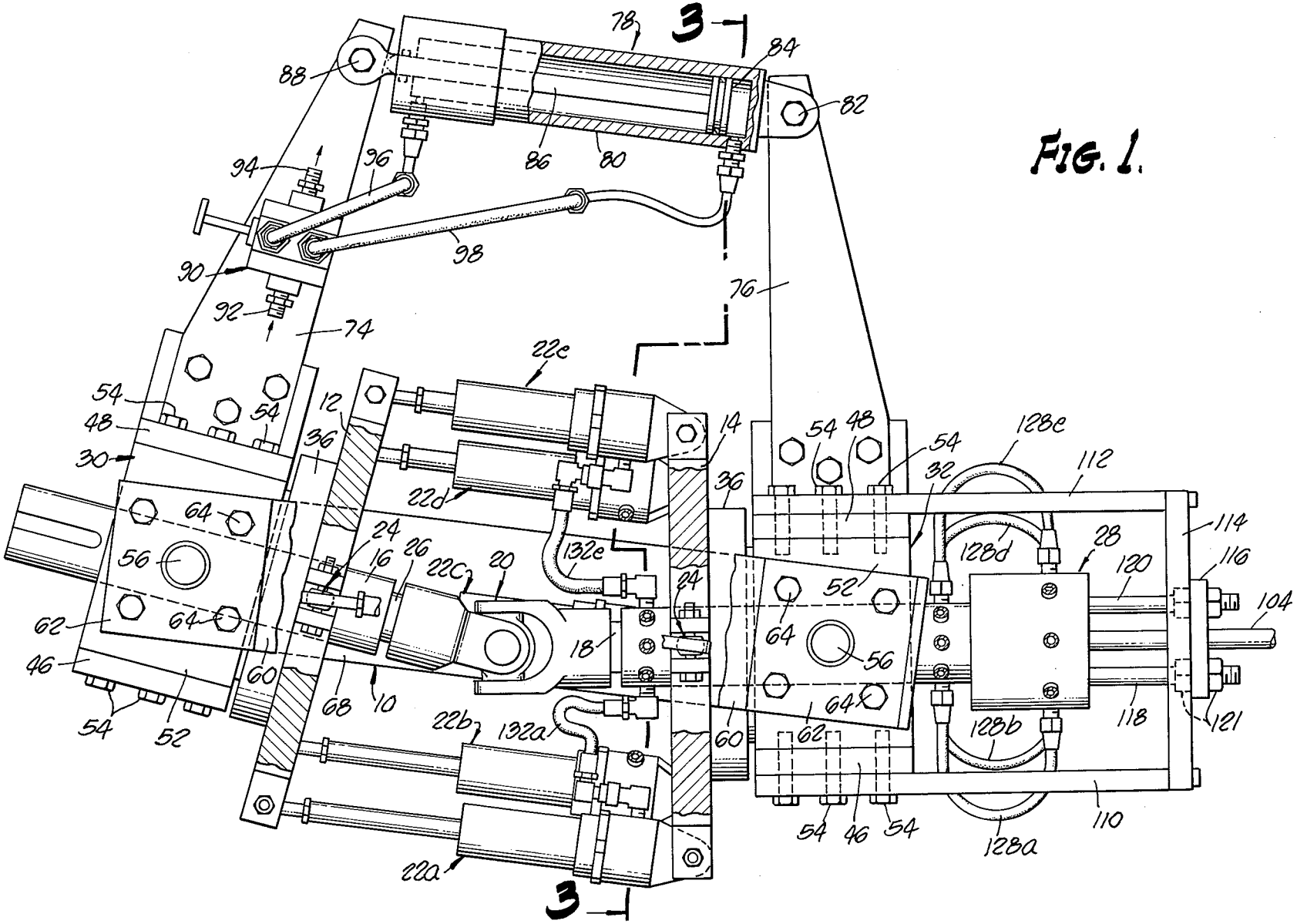
FIG. 1 is a top plan view, partly broken away and in section, showing a fluid operated engine according to the present invention.
Figure 2:
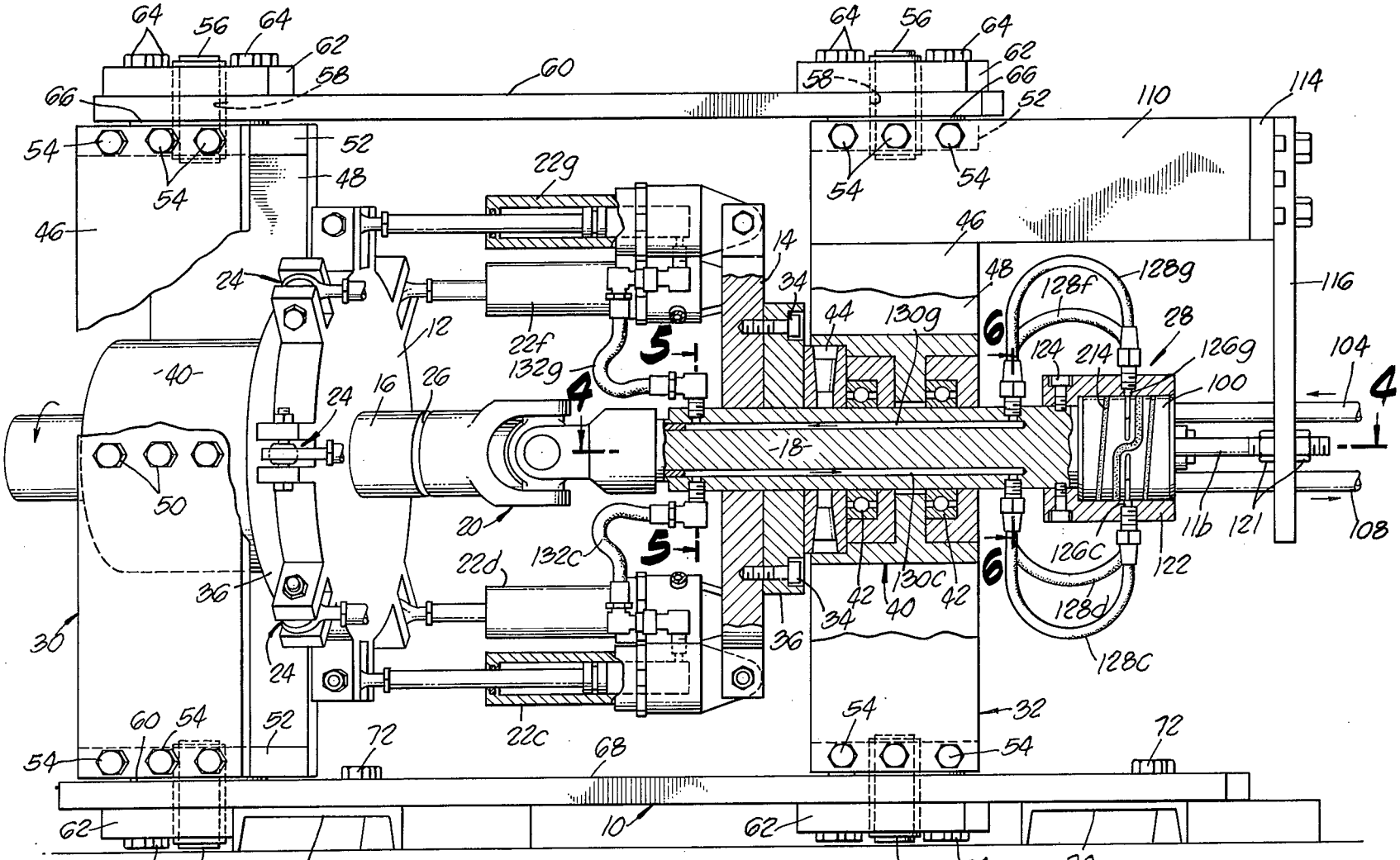
FIG. 2 is a side elevational view, partly broken away and in section, showing the engine of FIG. 1.

Referring more specifically to the drawings, for illustrative purposes, the invention is shown in FIGS. 1 and 2 as comprising a main frame structure 10 of generally rectangular configuration upon which a pair of disc-like plate members 12 and 14 are rotatably supported in confronting spaced apart relation, the plate members being respectively mounted on main driving shaft sections 16 and 18, these sections having adjacently positioned inner ends which are interconnected for unitary rotation by means of a universal joint 20 to permit the planes of rotation of the plate members 12 and 14 to be varied from a position in which they are in parallel relation to selective positions in opposed angular relation.

The discs 12 and 14 are interconnected by a plurality of fluid actuated axially expansile and retractile devices which are shown as comprising a plurality of cylinder-piston assemblies *22a, 22b, 22c, 22d, 22e, 22f, 22g,* and *22h.* These cylinder-piston assemblies are interconnected at their opposite ends with the members 12 and 14 by means of swivel-pivots 24 arranged at uniformly circumferentially spaced points on each of the plate members. Moreover, the plate members are relatively oriented on their axes so as to position their points of maximum spacing on one side of their axes and points of minimum spacing on the opposite side, when the plate members are moved into angularly disposed relation. In order to accommodate the angular changes in the connected shaft sections 16 and 18, due to the change in angularity between the discs 12 and 14, one of the shaft sections, in this case the shaft section 16, is provided with a splined portion as indicated by the numeral 26.

For producing rotation of the cylinder-piston assemblies, the connected plate members 12 and 14, and the shaft sections 16 and 18 as a unit, synchronized valve means 28 are provided to supply fluid under pressure to the respective cylinder-piston assemblies when they are in a rotational sector following the point of minimum spacing between the plate members 12 and 14, and discharge the fluid from the cylinder assemblies when they are in a rotational sector following the points of maximum spacing between the members 12 and 14.

Having in mind the components of the engine as described above, it will be appreciated that a force F axially applied against the periphery of an inclined disc, such as the plate members 12, 14, at any point P can be resolved into three components: radial, axial, and tangential. Accordingly, the torque produced will ge given by the equation: $T = \overline{F}_t \times r$ where T = the torque, $\overline{F}_t$ = the tangential force component, and $r$ = the radius of the point P. If two discs are connected for simultaneous rotation and are relatively angularly positioned so as to have minimum points of separation on one side and maximum points of separation on the opposite side, a thrust force applied between them at their closest points of separation will generate a torque in each disc in a direction which will cause the discs to turn until the aforementioned points of force application reach a position substantially 180° away in which the points will be at their maximum separation. At the point of maximum separation, $\overline{F}_t = 0$ and, accordingly, the torque is necessarily also 0. By removing the thrust force from the discs at this point of maximum separation and applying another thrust force at the minimum points of separation, the discs will be caused to rotate continuously. This is the basic principle of the fluid operated engine according to the present invention.

Although eight cylinder-piston assemblies have been illustrated in the drawings, it is to be understood that a greater or lesser number may be used and as few as two such assemblies can be employed in a working engine. Thus, the number of cylinder-piston assemblies or other force applying devices may vary depending upon operating requirements.

As best shown in FIGS. 1 and 2, the plate members 12 and 14 are respectively rotatably supported in tiltable yoke structures 30 and 32 at opposite ends of the main frame structure 10. Since the plate members 12 and 14 are similarly constructed and mounted, it is believed that it will only be necessary to describe one of them in detail. As best shown in FIG. 2, the plate 14 is mounted on the shaft section 18 in right angled relation to the shaft axis, and is secured as by a plurality of retaining bolts 34 to an annular back-up plate 36 which is fixedly secured to the shaft 18 as by a plurality of radial set screws 38, or other appropriate means. The shaft 18 is rotatably supported within a bearing housing 40 which mounts axially spaced radial anti-friction bearings 42 which stabilize the shaft alignment, and an anti-friction axial thrust bearing 44 receives the thrust forces from the back-up plate 36.

The bearing housing 40 for the plate member 14 is carried by the yoke structure 32, and in a similar manner the bearing housing 40 for the plate member 12 is carried by the yoke structure 30. Each of the yoke structures comprises an elongate frame structure which is composed of a pair of side plates 46 and 48 which extend on opposite sides of the bearing housing 40 and are secured thereto between their respective ends by a plurality of retaining bolts 50. At one end, the side plates 46 and 48 are secured to an end plate 52 as by securing bolts 54. The end plate 52 carries a projecting trunnion 56 which extends through an opening 58 at one end of a top beam member 60 of the main frame structure and is rotatably supported in a mounting plate 62 secured to the beam member 60 by securing bolts 64. Preferably, a thrust washer 66 is placed between the end plate 52 and the adjacent end of the beam member 60 to provide appropriate clearance. The opposite end of the yoke structure is similarly supported on a bottom beam member 68 of the main frame structure, this beam being fixedly secured to supporting base channels 70 as by retaining bolts 72. With the trunnioned supporting yokes as described above, it will be appreciated that the yokes may be tiltably adjusted to vary the angular relationship between the plate members 12 and 14, as well as to bring them into parallel relationship.

Provision is made for adjustably controlling the angular positions of the yokes 30 and 32 in order to vary the direction and speed of rotation of the engine, and for effecting an operating position in which there will be no rotation of the driving shaft. For this purpose, as shown in FIG. 1, the yoke structures 30 and 32 are provided with radially extending crank arms 74 and 76 respectively. These crank arms at their base ends are fixedly secured to the associated yoke structure, and at their outermost ends are interconnected by actuator means, as generally indicated by the numeral 78, by means of which the crank arms may be pivoted on the trunnions of their associated yoke structures to move the outer ends towards or away from each other. The actuator means may take various forms, but has been illustrated herein as comprising a fluid actuated power device of the double-acting cylinder-piston type in which a cylinder 80 has one end connected to the outermost end of the crank arm 76 by a connection 82, and an operatively associated piston 84 on a piston rod 86 which is connected to the outer end of the crank arm 74 by a connection 88. A 4-way manually operable valve 90 is shown as being mounted on the crank arm 74 for conveniently controlling the actuator. This valve has a pressurized fluid inlet connection 92, an outlet connection 94, and connections with flow lines 96 and 98 in communication with the opposite ends of the cylinder 80. Thus, the actuator 78 can be adjustably extended or retracted as desired to control the operation of the engine direction and speed, or stop its rotation.

ONE CONTROL VALVE ARRANGEMENT

The valve means 28, in the embodiment shown in FIGS. 1, 2 and 7, comprises a stationary valving element 100 having an inlet port 102 which is connectable with a high pressure fluid supply line 104, and a discharge port 106 which is connectable with a fluid discharge line 108. The supply line 104 may be connected with any suitable source of high pressure fluid, such as nitrogen, steam, air, products of combustion and the like which may be employed to actuate the engine. The discharge line 108 may be connected to a recovery system or in some cases merely vent the fluid to atmosphere. The stationary valving element is shown as being supported from the yoke structure 32 by means of an offset framework which includes a pair of projecting frame members 110 and 112, these frame members being secured at their innermost ends to the side plates 46 and 48 by the same bolts 54 that secure these plates to the associated end plate 52. The outer ends of the frame members 110 and 112 are interconnected by a bridging frame member 114, from which there depends a hanger member 116. The valving element is supported coaxially with the outermost end of the shaft section 18 by means of a pair of parallel spaced apart studs 118 and 120 which have their innermost ends threadedly connected to the valving element and their outermost ends extending through appropriate openings at the lowermost end of the hanger member and being fixedly secured in each case by inner and outer stud nuts 121.

The stationary valving element 100 is operatively associated with a surrounding rotatable manifold element 122 of annular configuration and having its innermost end secured to the outermost end of the shaft 18 by means of a plurality of set screws 124 for rotation as a unit with the shaft. As best shown in FIG. 8, the manifold element 122 is circumferentially provided with peripheral flow ports 126*a*, 126*b*, 126*c*, 126*d*, 126*e*, 126*f*, 126*g*, and 126*h*. These flow ports are respectively connected by hose assemblies 128*a*, 128*b*, 128*c*, 128*d*, 128*e*, 128*f*, 128*g*, and 128*h*, as shown in FIG. 6, with corresponding axially extending shaft passages 130*a*, 130*b*, 130*c*, 130*d*, 130*e*, 130*f*, 130*g*, and 130*h* extending axially through the shaft section 18. As shown in FIG. 5, these shaft passages are respectively connected by means of hose assemblies 132*a*, 132*b*, 132*c*, 132*d*, 132*e*, 132*f*, 132*g*, and 132*h* with the cylinder-piston assemblies 22*a*–22*h* as shown in FIG. 3. With the connections as described above, it will be evident that the rotation of the manifold element 122 will sequentially place the cylinder-piston assemblies in communication with the pressurized fluid received by the stationary valving element 100 as well as sequentially connect the cylinder-piston assemblies to discharge their low pressure fluid through the stationary valving element 100.

Referring more specifically to FIGS. 7–10, the valving element is of cylindrical configuration and externally of a diameter to slidingly fit within an inner cylindrical surface 134 of the manifold element 122. The valving element is formed with a central bore 136 which operatively receives a sleeve bushing 138 by which it is journalled upon an end projection 140 of the shaft 18, this projection having a reduced diameter.

The valving element is further formed intermediate its ends with a pair of circumferentially aligned radial arcuate recesses 142 and 144 which have their adjacent opposite ends in spaced apart relation. The recess 142 is in communication with the inlet port 102, and the recess 144 is in communication with the discharge port 106. Moreover, the recesses are designed with a depth and contour that will provide the required fluid flow volume necessary to operate the engine efficiently. A continuous sealing ring 146 is seated in a circumferentially extending groove 148 formed on the outer cylindrical surface 200 of the valving element. This groove is longitudinally configured so as to support the associated sealing ring with a first section 202 extending in parallel spaced relation along one side of the circumferential opening of recess 142 and a second section 204 extending on the opposite side of the circumferential opening of the recess 144. Cross-over sealing ring portions 206 and 208 extend between the spaced ends of the recesses 142 and 144 at the diametrically opposite sides of the valving member, and serve to sealingly circumferentially separate the recesses from each other.

In addition to the sealing ring 146, the valving element is also provided on its outer surface with circumferentially extending grooves 210 and 212 for the reception of appropriate ring seals 214 and 216 respectively. These grooves and associated seals are positioned on opposite sides of the sealing ring 146 and in outwardly spaced relation thereto. Also, the planes of the grooves 210 and 212 are angularly inclined with respect to the axis of the valving element 100, and as so arranged produce a relative nutating effect with respect to the manifold element 122. The inclination of the sealing rings 214 and 216, and the oblique angle of the cross-over portions 206 and 208 provide a method for lubricating the seals with a suitable lubricant which is inherently contained in the medium used to power the engine, or a lubricant which may be introduced in proper quantities into those media, which do not inherently contain a lubricant, prior to reaching the valve inlet. Devices for the introduction of lubricant, although not shown, are well known in the industry and commercially available.

ALTERNATE CONTROL VALVE ARRANGEMENT

An alternate control valve arrangement is disclosed in FIGS. 11–13, which similarly contains a valving element and manifold element which function in a similar manner to those of the previously described valve. However, the relationship is reversed in that the valving element surrounds the manifold element.

More specifically, in this valve arrangement a shaft section 218, which corresponds to the previously described shaft 18, is formed with an end portion which constitutes a manifold element 220. The manifold element is in this case rotatable within an outer stationary annular valving element 222 which is mounted on supporting studs 224 and 226 in a manner similar to that used for the mounting of the valving element 100.

In this arrangement, the shaft end is provided with a plurality of radial circumferentially spaced flow passages 228*a*, 228*b*, 228*c*, 228*d*, 228*e*, 228*f*, 228*g*, and 228*h* which are in communication with corresponding axially extending shaft passages 230*a*, 230*b*, 230*c*, 230*d*, 230*e*, 230*f*, 230*g*, and 230*h* which are connected at their inner ends respectively with the cylinder-piston assemblies by means of the hose assemblies as previously described.

The valving element 222 in this case is also provided with a pair of recesses 232 and 234 which are formed on the inner cylindrical surface 236 of the valving element 222, the recess 232 being in communication with an inlet port 238, and the recess 234 being in communication with an outlet port 240. These recesses are sealed with respect to each other by means of a circumferentially extending groove 242 and associated sealing ring 244 which bears against the outer cylindrical surface 246 of the manifold element. This sealing ring, as in the case of the previously described valve, has circumferentially extending sections 248 and 250 and cross-over sections 252 and 254. The alternate valve arrangement further differs in that flanking circumferentially extending grooves 256 and 258 are in this case formed in the outer cylindrical surface 246 of the manifold element instead of the valving element, and having positioned therein ring seals 260 and 262 having peripheral engagement with the inner cylindrical surface 236 of the valving element. The sealing rings as just described functionally operate for the same purpose as in the first described valve arrangement.

OPERATION OF THE ENGINE

Since the two embodiments of the valve means 28 as described herein operate and function in the same manner, the engine operation will be considered with reference to the first discussed valve arrangement as shown in FIGS. 7 and 8.

The stopped and running modes of the engine are determined by the relative relationship of the plate members 12 and 14 through the selective operation of the actuator means 78. With the plate members in parallel relation, the engine will be in a "stopped" mode, whereas, if the plate members are relatively inclined with respect to each other, the engine will be in a "running" mode. The direction of rotation will depend upon whether the plate members are inclined in one direction or in an opposite direction from their parallel positions.

Having reference to FIG. 8, it will be observed that the cylinder-piston assemblies which are in communication with the flow ports of the manifold element, which are in communication with the recess 142, will be supplied with pressurized fluid. The cylinder-piston assemblies which are in communication with the recess 144 will be relieved of their pressurized fluid. However, since the plate members are in parallel relation, the cylinder-piston assemblies which are supplied with pressurized fluid will be ineffective to produce rotation.

With the plate members shifted to effect a running mode of the engine, the cylinder-piston assemblies, which are supplied with pressurized fluid, will produce rotational torque forces. Assuming that the manifold element 122, as shown in FIG. 8, is being rotated in a clockwise direction, it will be evident that as each of the flow ports pass the seal cross-over section 208, it will be placed into communication with the recess 142 and thus supply pressurized fluid to its associated cylinder-piston assembly until the flow port passes the cross-over section 206, whereupon the flow port will be connected with recess 144 and its associated cylinder-piston assembly will be relieved of its fluid pressure. As each cylinder-piston assembly is relieved of its pressure, the piston is then enabled to move to its retracted position.

If the rotation is in a counterclockwise direction, the cylinder-piston assemblies will be sequentially supplied with pressurized fluid as their associated flow port moves past the cross-over section 206 into communication with the recess 142. The speed of rotation in either running mode direction will be determined by the extent of angularity between the plate members 12 and 14 and will decrease as the plate members approach parallel relationship.

While the present invention has been illustrated and described as a prime mover, it is not strictly limited to such use, and is equally applicable to operation as a positive displacement pump.

It will be appreciated from the description and drawings, that an engine according to the present invention provides a simple, rugged, lightweight, yet efficient and reliable prime mover which may be operated from any suitable source of pressurized fluid, and the need for combustible fuels is completely eliminated. Tests have indicated that an engine constructed according to the present invention is capable of operating at a relatively low pressure of, for example, 1000 psi and at a comparatively low angular velocity of the order of 1000 rpm, while delivering in excess of 100 brake horsepower. The design is readily adaptable to provide higher speeds of operation of the engine even at the comparatively low pressure mentioned. In addition, when higher pressure fluid media become available, the engine according to the present invention can be readily adapted to their use.

Various modifications may suggest themselves to those skilled in the art, without departing from the spirit of this invention, and hence, it is not to be restricted to the specific forms shown or uses mentioned, except to the extent indicated in the appended claims.

What is claimed is:

1. A fluid operable engine, comprising:

(a) a frame structure;

(b) a pair of confronting spaced apart disc-like plate members respectively mounted on said frame for rotation about a right-angled axis of rotation, said plate members being relatively oppositely inclined with respect to each other and relatively oriented on their axes to position points of maximum spacing on one side of their axes and points of minimum separation on an opposite side;

(c) a plurality of pressurized fluid actuated axially expansile and retractile devices extending between and being connected to corresponding circumferentially spaced points of said members;

(d) power delivery shaft means connecting said members for simultaneous rotation comprising separate shaft sections fixedly supporting said members and being independently supported for rotation at opposite ends of said frame structure, said shaft sections having adjacent ends disposed between said members interconnected by a universal joint;

(e) a bearing assembly containing radial and axial thrust bearing elements for supporting each of said shaft sections, each of the bearing assemblies being supported on the frame structure for swinging movements to change the angular relationship of said shaft sections and said members thereon with respect to each other; and (f) valve means operable in synchronized timed relation to said rotation for sequentially controlling the actuating fluid for said devices so as to cause rotation of said members and the connected power delivery shaft.

2. An engine as set forth in claim 1 in which the bearing assemblies are mounted on pivoted yokes respectively at opposite ends of said frame structure; and including an actuator connected with said yokes and being operable to selectively shift said plate members to positions for respectively causing shaft rotation in one direction, non-rotation, and rotation in a direction opposite to said one direction.

3. An engine as set forth in claim 2, in which a crank arm extends radially outwardly from each of said yokes; and in which the actuator comprises power means connected between the outer ends of the crank arms, said power means being selectively energizable to swing the outer ends of the crank arms towards and away from each other.

4. An engine as set forth in claim 3, wherein said power means comprises a double-acting pressurized fluid actuated cylinder-piston means.

5. A fluid operable engine, comprising:

(a) a frame structure;

(b) a pair of confronting spaced apart disc-like plate members respectively mounted on said frame for rotation about a right-angled axis of rotation, said plate members being relatively oppositely inclined with respect to each other and relatively oriented on their axes to position points of maximum spacing on one side of their axes and points of minimum separation on an opposite side;

(c) a plurality of pressurized fluid actuated axially expansile and retractile devices extending between and being connected to corresponding circumferentially spaced points of said members, each of said devices comprising a cylinder and piston assembly, the piston having a swivel-pivot connection with one of said plate members, and the cylinder having a swivel-pivot connection with the other of said plate members, said connections enabling independent removal and replacement of said devices;

(d) rotatable shaft means connecting said members for simultaneous rotation comprising independently rotatably supported separate shaft sections having adjacent ends interconnected by a universal joint, one of said shaft sections constituting a power delivery shaft, and the other of said shaft sections being formed with a plurality of separate axial passages therein;

(e) removably mounted flow conduits respectively connecting said devices with said axial passages; and (f) valve means operable in response to the rotation of said interconnected shaft sections for sequentially controlling the flow of actuating fluid through said axial passages and flow conduits for said devices so as to cause rotation of said members and the connected shaft sections.

6. A fluid operable engine as set forth in claim 5, wherein said valve means comprises a stationary valving element having a fluid inlet connection and a fluid discharge connection, and a manifold element driven by said other of said shaft sections and concentrically surrounding the valving element and being provided with a plurality of flow ports respectively communicating with said axial passages, said valving element and said manifold element being relatively rotatable and operatively coacting to sequentially connect said flow ports with said inlet and discharge connections.

7. A fluid operable engine as set forth in claim 5, wherein said valve means comprises a valving element having a fluid inlet connection and a fluid discharge connection, and a manifold element formed by said other of said shaft sections concentrically surrounded by the valving element and having flow ports respectively communicating with said axial passages formed in its periphery.

8. A fluid operable engine, comprising:

(a) a frame structure;

(b) a pair of confronting spaced apart disc-like plate members respectively mounted on said frame for rotation about a right-angled axis of rotation, said plate members being relatively oppositely inclined with respect to each other and relatively oriented on their axes to position points of maximum spacing on one side of their axes and points of minimum separation on an opposite side;

(c) a plurality of pressurized fluid actuated axially expansile and retractile devices extending between and being connected to corresponding circumferentially spaced points of said members, each of said devices comprising a cylinder and piston assembly, the piston having a swivel-pivot connection with one of said plate members, and the cylinder having a swivel-pivot connection with the other of said plate members;

(d) power delivery shaft means connecting said members for simultaneous rotation; and (e) valve means operable in synchronized timed relation to said rotation for sequentially controlling the actuating fluid for said devices so as to cause rotation of said members and the connected power delivery shaft, said valve means comprising:

a stationary valving element having a fluid inlet connection and a fluid discharge connection, and a manifold element driven by said shaft concentrically surrounding the valving element and being provided with a plurality of flow ports respectively communicating with said cylinders, said valving element and said manifold element being relatively rotatable and operatively coacting to sequentially connect said flow ports with said inlet and discharge connections, said valving element being of cylindrical configuration and being provided with a pair of radial circumferentially extending arcuate recesses having their opposite adjacent ends in spaced relation, one of said recesses being in communication with the fluid inlet connection and the other recess being in communication with the discharge connection, and circumferential sealing means between the valving element and manifold element for sealingly isolating the recesses from one another.

9. An engine as set forth in claim 8, in which the sealing means includes a continuous sealing ring disposed with a first section extending in parallel spaced relation along one side of one of the recesses and a second section extending in parallel spaced relation along the other side of the other of the recesses; and in which said sealing ring has cross-over portions extending between the spaced adjacent ends of the recesses.

10. An engine as set forth in claim 8, in which the sealing means includes a pair of seals respectively on opposite sides of said recesses, said seals being axially inclined relative to the longitudinal axis of the valving element.

* * * * *